US005368132A

United States Patent [19]

Hollowell et al.

[11] Patent Number: 5,368,132

[45] Date of Patent: Nov. 29, 1994

[54] SUSPENDED ELEVATOR CAB MAGNETIC GUIDANCE TO RAILS

[75] Inventors: Richard L. Hollowell, Amston; John K. Salmon, South Windsor, both of Conn.

[73] Assignee: Otis Elevator Company, Farmington, Conn.

[21] Appl. No.: 147,192

[22] Filed: Nov. 3, 1993

[51] Int. Cl.[5] ..... B66B 7/04

[52] U.S. Cl. ..... 187/393; 187/406

[58] Field of Search ..... 187/95, 1 R

[56] References Cited

U.S. PATENT DOCUMENTS

| | | | |
|---|---|---|---|
| 2,246,732 | 6/1941 | Hymans | 187/1 R |
| 3,332,517 | 7/1967 | Voser | 187/95 |
| 3,669,222 | 6/1972 | Takamura et al. | 187/95 |
| 4,529,062 | 7/1985 | Lamprey | 187/1 R |
| 4,754,849 | 7/1988 | Ando | 187/95 |
| 4,899,852 | 2/1990 | Salmon et al. | 187/1 R |
| 5,086,882 | 2/1992 | Sugahara et al. | 187/95 |
| 5,107,963 | 4/1992 | Rocca et al. | 187/95 |
| 5,117,946 | 6/1992 | Traktovenko et al. | 187/95 |
| 5,199,529 | 4/1993 | Salmon | 187/1 R |
| 5,289,902 | 3/1994 | Fujita | 187/95 |

FOREIGN PATENT DOCUMENTS

| | | | |
|---|---|---|---|
| 0467673A2 | 1/1992 | European Pat. Off. . | |
| 54-144645 | 11/1979 | Japan | 187/95 X |
| 388687A | 4/1991 | Japan | 187/95 X |
| 5124783A | 5/1993 | Japan | 187/95 X |
| 1030728 | 5/1966 | United Kingdom | 187/95 X |
| 2262932A | 7/1993 | United Kingdom | 187/95 X |

*Primary Examiner*—Robert P. Olszewski
*Assistant Examiner*—Dean A. Reichard

[57] ABSTRACT

A pendulum cab (13) is movably suspended from the frame (30) of an elevator car such as by rods (29) and stabilized by means of electromagnetic actuators (41–45) which interact directly with the hoistway rails (22) in response to signals from accelerometers (66–68) disposed on a platform (28) of the cab as well as proximity sensors for locking up the cab while at a landing.

5 Claims, 3 Drawing Sheets

| | 43.45 | | 44 |
|---|---|---|---|
| cm | INCH | | cm | INCH |
| 7.5 | 3 | a | 7.5 | 5 |
| 25.0 | 10 | b | 35.0 | 14 |
| 10.0 | 4 | c | 10.0 | 4 |
| 3.0 | 1 1/4 | d | 3.0 | 1 1/4 |
| 2.5 | 1 | e | 1.5 | 5/8 |

SUSPENDED ELEVATOR CAB MAGNETIC GUIDANCE TO RAILS

TECHNICAL FIELD

This invention relates to guiding the position of a pendulum elevator cab suspended on a frame in inertial space by means of magnetic forces applied directly between the cab and the rails.

BACKGROUND ART

A prior art elevator car 12 (FIG. 1) includes a cab 13 rigidly disposed within a frame extending beneath a cross head 14 suspended by steel ropes 15 from a motor driven sheave (not shown). The frame of the car 12 includes two or more vertical stiles 19 extending from the cross head 14 to one or more planks 20 at the bottom of the car. A plurality of guides 21 position the elevator car with respect to a pair of hoistway rails 22 which are disposed to a building by brackets, in the known fashion. Each of the guides 21 typically comprise two or three wheels so as to provide guiding support in the front-to-back direction (into and out of the page as viewed in FIG. 1) as well as in the side-to-side direction (right to left as viewed in FIG. 1). Typically, there will be four guides 21 as seen in FIG. 1.

In the prior art, the guides 21 may be passive, meaning they have only spring and dashpot dampening on each of the wheels so as to smooth the ride. Guides of this type are shown, for example, in Skalski et al U.S. Pat. No. 5,117,946. On the other hand, the guides 21 may be active as shown in Skalski and Traktovenko U.S. patent application Ser. No. 08/021,649, filed Feb. 16, 1993, a continuation of Serial No. 07/731,185, filed Jul. 16, 1991, the subject matter of which is also shown in European Patent Application Pub. No. 0 467 673 A2. Active guides include actuators which can move the car 12 fore and aft as well as right and left to compensate for deviations in the rails 22 from straight vertical lines or planes in inertial space, and for other forces on the car. In elevators of the type shown in FIG. 1, it has been known to use electromechanical actuators and electromagnetic actuators for compensation. Such systems are generally extremely complicated and thus far have met with limited success. The actuators may be driven by a controller 24 in response to previously-recorded maps of the incremental positioning of the rail throughout the hoistway, to accelerations of the car 12 from sensors 25, 26 on the top and bottom of the car, and to a variety of other indications of the deviation of the rail or the motion of the car. However, variations in car position are also due to loading within the car 12, interference in stabilizing the car position with respect to one rail as a consequence of contemporaneously attempting to stabilize position with respect to the other rail, car oscillation and other noise. A significant problem is that the amount of correction which can be provided with present day safety devices is severely limited by the clearance (only a few millimeters) between the safety blocks and the rails. This provides less than adequate room within which to compensate for rail deviation and car motion.

In FIG. 2, another type of prior art elevator car 12, sometimes referred to as a "pendulum cab", has the cab 13 disposed on a platform 28 which is suspended by rods 29 from side frames 30 that extend fore-and-aft of the cross head 14 and are suspended from the cross head 14 by means of the stiles 19, or otherwise. Typically, there are four rods 29, one near each corner of the cab 13, which engage side frames 28*a*, 28*b* of the platform 28. The pendulum suspension tends to isolate the cab 13 from the jostling and vibration induced on the car by the rails 22. However, there is a tendency for the cab 13 to oscillate as a consequence of repetitive accelerations imparted thereto within the oscillatory frequency band of the rod suspension. In order to reduce the oscillations, compensation 31, such as damping, is typically provided between the platform 28 and the plank 20. The damping may be simple elastomeric supports, or may be spring/dashpot damping designed to minimize the effects at particular frequencies, as in Salmon et al U.S. Pat. No. 4,899,852.

Instead of just damping between the platform 28 and the planks 20, the cab 13 may be actively guided by the compensation 31 so as to have less lateral (side-to-side) movement, utilizing electromechanical or electromagnetic systems similar to those used for guiding the car as described with respect to FIG. 1. However, the active or passive control of lateral vibration of a cab suspended in the frame is simpler than guiding the car with respect to the rails because the cab has no relative vertical motion with respect to the frame of the car. In the aforementioned European Publication, there is disclosed a plurality of electromagnetic actuators which include C-shaped cores with electric coils on them operating against ferromagnetic reaction plates. In essence, the plates are disposed on the platform 28 and the electromagnets are disposed on the plank 20. The use of active electromagnetic actuators in a pendulum car of the type shown in FIG. 2 is well suited to counteract not only side-to-side oscillations and vibrations induced to the cab through the frame by the rails, but also forces (including torsional forces) acting directly on the suspended cab including wind forces (from the passage of adjacent elevators), passenger motion within the cab, and otherwise. The problem with such a system is that the electromagnetic actuators are pushing from the cab to the frame, which in turn reacts through the guides 21 to the rails 22. The frame is therefor spongy and the intended reaction is not achievable; and, some of the forces are reflected back through the guides to the frame.

DISCLOSURE OF INVENTION

Objects of the invention include provision of an elevator car having a smooth ride, with reduced lateral motion, and reduced car motion when boarding and deboarding passengers.

According to the invention, an elevator car comprises a cab suspended on a frame which is guided by hoistway rails, and the cab is provided lateral (fore-and-aft, sideways) stabilization with respect to inertial space by means of electromagnetic actuators exerting force directly between the suspended cab and the hoistway rails. According further to the invention, the elevator car may be made much more quiet by means of magnetic guides between the car frame and the rails, which eliminate all of the noise otherwise generated by conventional roller guides. In use, the electromagnetic actuators are driven with appropriate current so as to provide forces up to on the order of 30 kilograms (about 65 pounds), in each direction. When the elevator is moving between floors, in response to any tendency of the cab to move in any lateral direction (particularly the right or left direction), an acceleration signal indicative thereof is utilized to cause a lesser force in the direction of the acceleration and a greater force opposite to the direction of the acceleration, so as to stabilize it. The force may be generally of the form: $-K/s$ times the acceleration, where K is the desired constant determined principally by the amount of damping desired, and s is the LaPlacian operator. Thus, a negative integral of acceleration is indicative of the corrective force to be provided by the magnets. When the elevator is at rest, a position signal provides an alteration in the sideways as well as the fore-and-aft position so as to lock the cab to a landing, to keep it from moving as passengers alight and depart, and to reduce sideways jostling from door action. This provides a significant advantage over prior cars which are found to be quite shaky during passenger loading and unloading, particularly in the fore-and-aft direction.

According to the invention still further, the electromagnetic actuators operative in the fore-and-aft direction may be disposed in planes different from the electromagnetic actuators operating in the sideways direction, for reduced cross coupling of the axes.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 2:
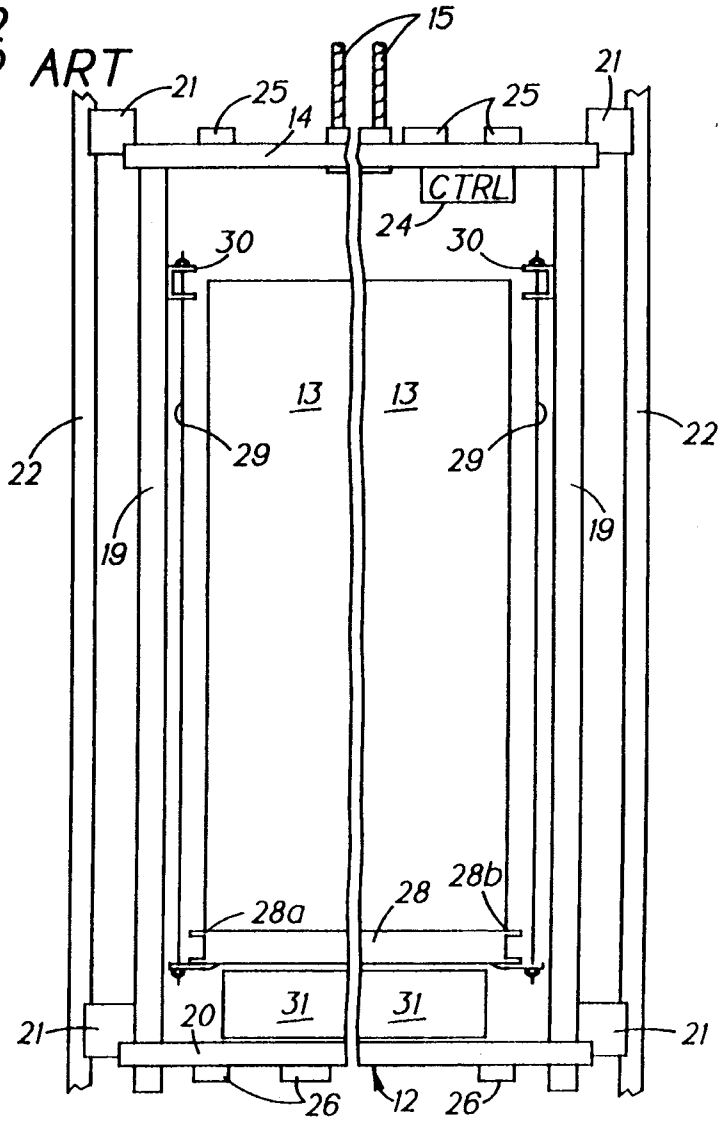
FIG. 2 PRIOR ART
FIG. 2 is a simplified, stylized block diagram of the front of an elevator car having a suspended cab according to the prior art.
Figure 1:
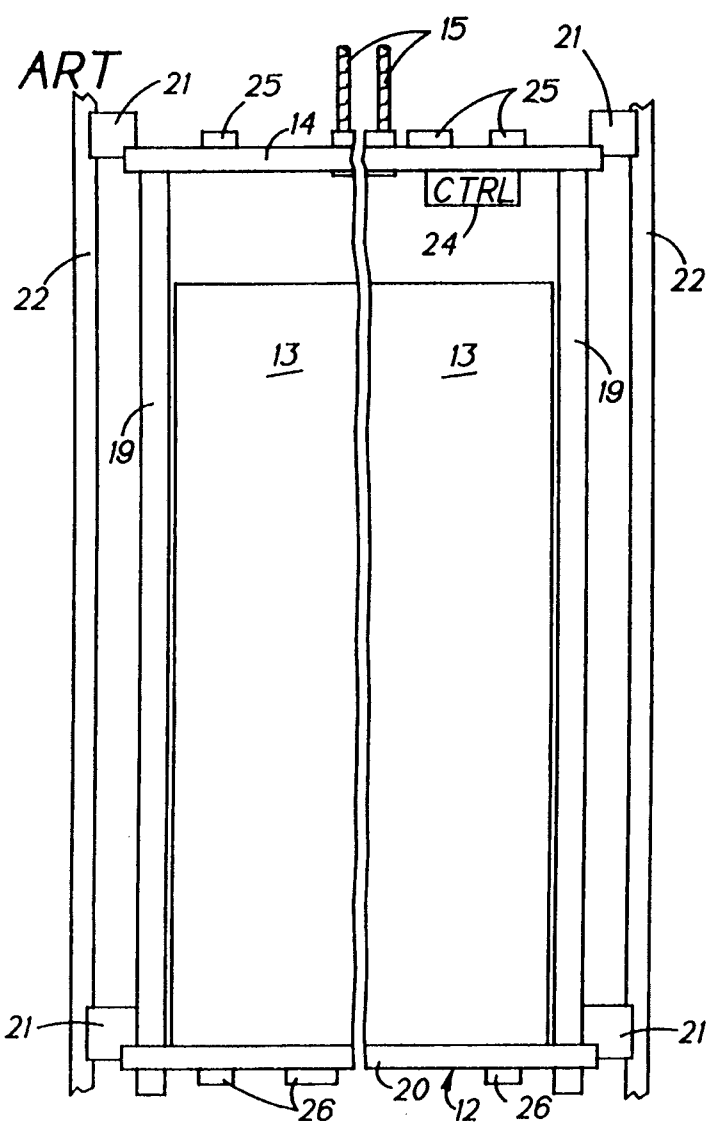
FIG. 1 PRIOR ART
FIG. 1 is a simplified, stylized block diagram of the front of a prior art elevator car with a rigid cab.
Figure 4:
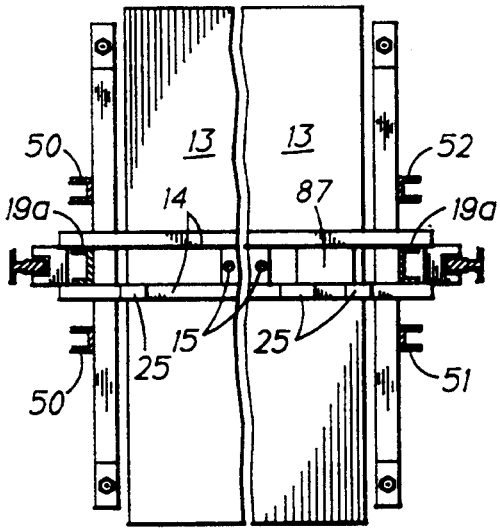
FIG. 4 is a simplified, stylized, top plan view of the elevator of FIG. 3.

Referring now to FIGS. 3–7, a plurality of electromagnetic actuators 41–45 are mounted by corresponding brackets 46–49 on fore-and-aft frame members **28*a*, 28*b* of the platform 28. Since the electromagnetic actuators 41–45 are not disposed on the stiles 19, a split stile arrangement may be utilized employing at least a pair of stiles 50–52 at each end of the elevator, with the normal stile 19 (FIGS. 1 and 2) being truncated so as to provide an upper stile member 19*a* for holding the guide 21 at the top of the elevator car and a lower stile member 19*b* for holding the guide 21 at the lower part of the elevator car. The stile member 19*a* may terminate in the fore-and-aft frame 30, and the stile member 19*b* may be supported between the split stiles 51, 52 by use of a frame member 53**.

Figure 6:
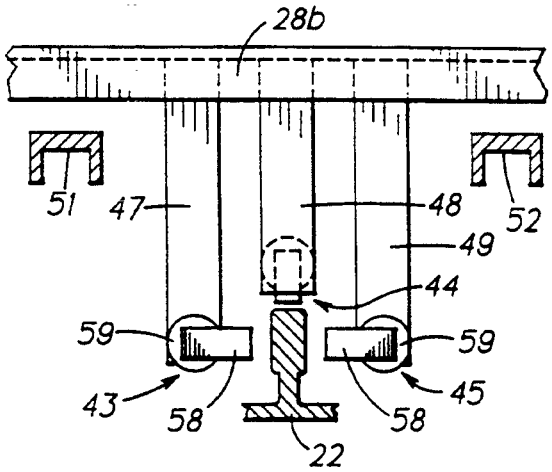
FIG. 6 is a fragmentary sectional view taken on the line 6—6 of FIG. 5.
Figure 8:
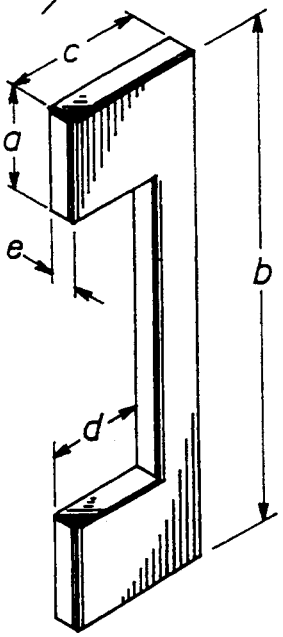
FIG. 8 is a chart of exemplary core dimensions.
Figure 7:
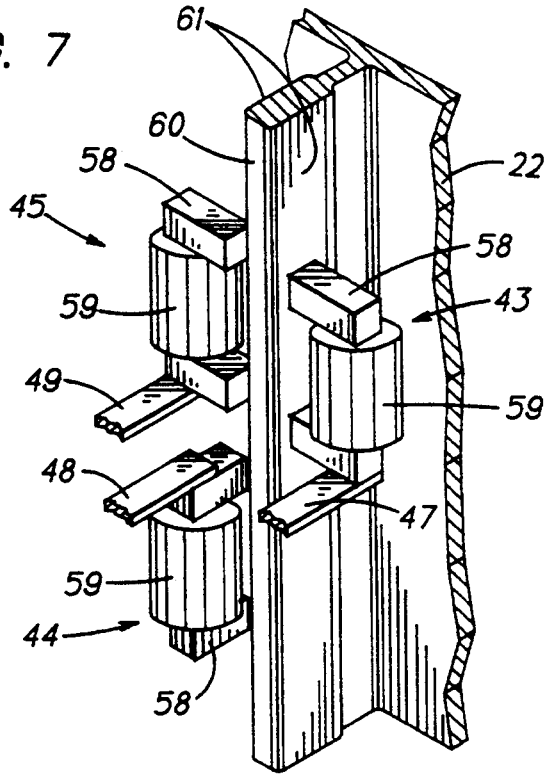
FIG. 7 is a partial perspective view of the hoistway rail and electromagnetic actuators for the elevator of FIGS. 3–6.

As seen in FIGS. 6 and 7, each of the electromagnetic actuators 41–45 includes a C-shaped ferromagnetic core 58 and an electrically conductive coil 59 in the usual fashion. The cores 58 are disposed on the brackets 46–49 so as to provide an air gap of about one or two centimeters ($\frac{3}{8}$ to $\frac{3}{4}$ inch) between the cores 58 and the stem 60 of the rail 22 when the cab is at its nominal, centered position with respect to the rails 22. The cores of the actuators 43, 45 may be on the order of 2–3 centimeters (about 1 inch) in cross section and on the order of 20–30 centimeters (8–12 inches) from top to bottom. The core of the actuator 44 may be on the order of 30–40 centimeters (12–16 inches) in height, and 1–2 centimeters (about $\frac{5}{8}$ inch) in cross section. Other exemplary dimensions are illustrated in FIG. 8.

Figure 9:
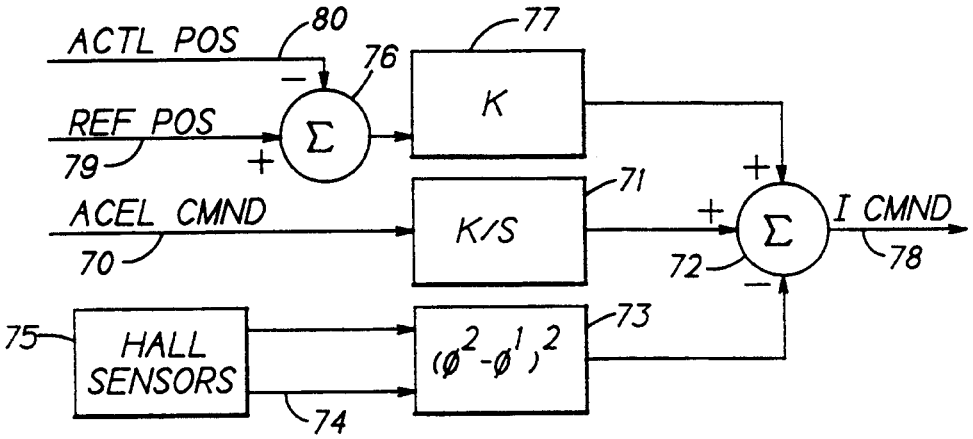
FIG. 9 is a partial, simplified block diagram of a part of a control which may be used with the invention.

In operation, the side-to-side electromagnetic actuators 42, 44 are operated differentially so as to attract the cab platform 28 toward the stem 60 (FIG. 7) of one of the rails 22 to oppose the direction of motion indicated by any lateral acceleration of the platform 28. The lateral acceleration may be sensed by a laterally-oriented accelerometer 66 (FIG. 3) disposed beneath the platform 28. The front-to-back electromagnetic actuators 41, 43, 45 work as pairs against the stem faces 61 of one of the rails 22 (FIG. 6), each pair of actuators responding to its own accelerometer 67 or 68 oriented for front-to-back accelerations on the same side of the platform 28 as the related electromagnetic actuators 41, 43, 45 are mounted. The actuators 43, 45 (FIGS. 3, 5 and 6) will respond to acceleration sensed by accelerometer 68, whereas the electromagnetic actuator 41 (and its companion actuator, not shown) react to the accelerometer 67 mounted on the left side of the platform 28. Thus there are three channels in this most simple embodiment: side-to-side; front-to-back on the left side; and front-to-back on the right side. Each of the channels may respond to the acceleration signal from the related accelerometer so as to provide an acceleration command (the acceleration reference being zero) on a line 70 (FIG. 9), which is fed to an integrating amplifier 71 having the general function $-K/s$ the output of which is a force command fed to a summing amplifier 72. To determine the amount of current necessary to implement the force command, flux squared is subtracted therefrom having been provided to the summing amplifier 72 by a squaring amplifier 73 in response to signals on lines 74 from hall sensors 75, indicative of the flux being generated by current in the corresponding electromagnetic actuator. The hall sensors are mounted at the faces of the cores 58, as shown in FIG. 47 of said European Publication. In FIG. 9, a position loop is utilized so as to force the platform 28 rigidly to the building when the car is stopped at a landing, thereby to hold it against jostling forces of passengers entering and leaving the cab. This includes a summing amplifier 76 that provides a position error signal through an amplifier 77 to the summing amplifier 72. The output of the summing amplifier 72 is a current command signal on a line 78, to be applied to the electromagnetic actuator drivers, all in the known way. When the elevator is stopped at a landing, a net forward force can be applied to each of the fore-and-aft electromagnetic actuator pairs so as to ensure that the elevator is locked to the landing. This can be achieved by providing, when at a landing, a position reference signal (in the fore and aft direction) which is beyond the landing and therefore unattainable, to guarantee a force command to lock the cab to the landing. The reference signal may be applied on a line 79 to the summer 76 which subtracts an actual position signal from a proximity sensor, not shown on a line 80 and passes the difference through the amplifier 77 to provide another force command to the summing amplifier 72. This is oversimplified. All of this is well known and is shown in detail in the aforementioned EPC patent application publication.

The invention operates properly while in motion between floors even though the variation in the forces and in the deviation of the rails causes the gap to vary, because the gap variation is at a much lower frequency (a few Hertz) than the response of the system (on the order of 50 Hertz) described herein when the elevator is running between floors. Thus, the variation in the gap has essentially no effect on the operation and can be ignored. As is known, the control band of the force generated as a function of acceleration is on the order of between 1 and 20 Hertz when traveling between floors.

Figure 3:
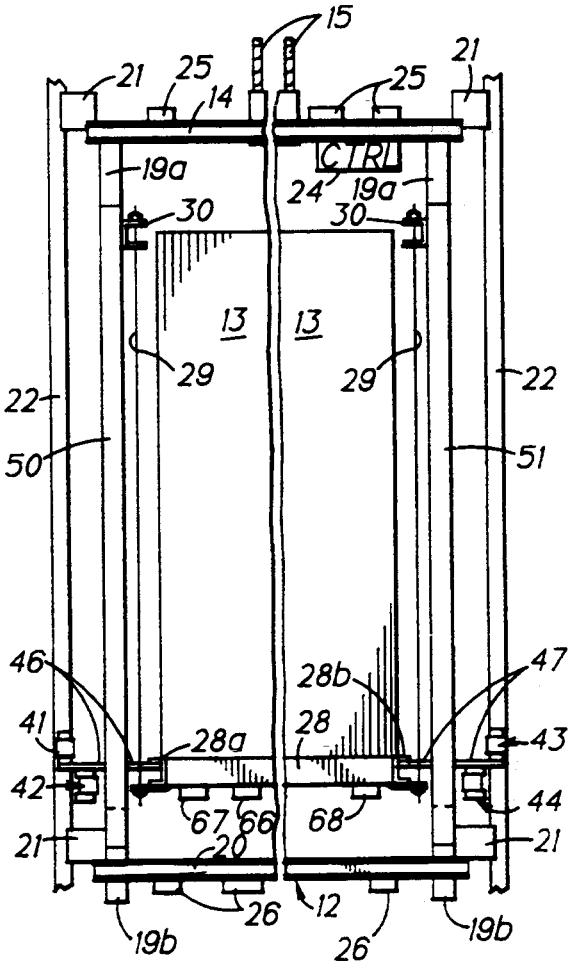
FIG. 3 is a simplified, stylized, front elevation view of a suspended cab elevator car incorporating the present invention.
Figure 5:
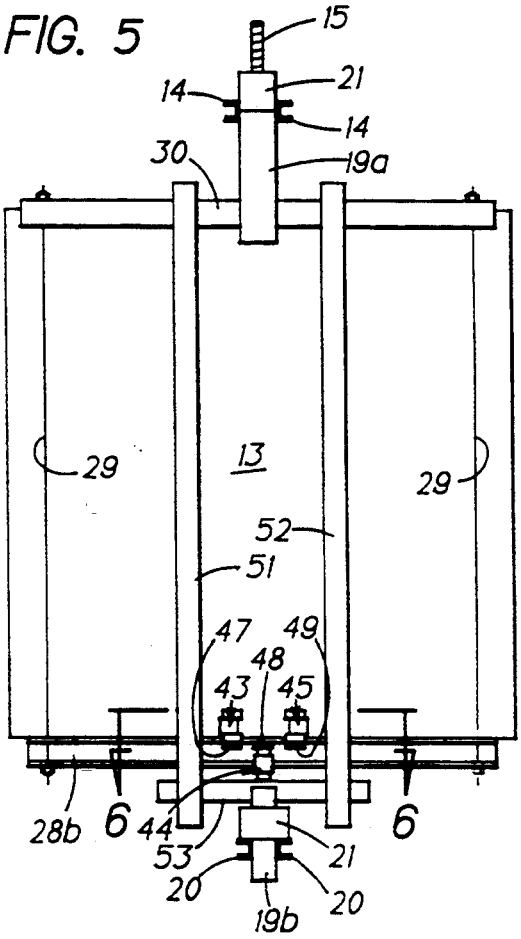
FIG. 5 is a simplified, stylized, side elevation view of the elevator of FIG. 3.

As seen in FIG. 3, the frame of the elevator 12 having the cab guides of the present invention may also be actively stabilized by utilizing magnetic guides 21, of the kind known to the prior art, which can respond to stabilizing signals from a control 24 in response either to mapping signals or motion signals from a plurality of motion detectors 25 and 26 at the top and bottom of the frame, respectively, in any suitable way known to the prior art, to enhance the value of the invention by providing contactless, and therefore noise-free stabilization. However, passive guides of the type described in the aforementioned Skalski et al patent may also be used to guide the frame, if desired.

The embodiment described involves a pendulum cab suspended by rods; in Salmon U.S. Pat. No. 5,199,529, a pendulum cab is suspended by roller mount assemblies; the invention may be used with either type of suspension. The invention may be used with other rail shapes, as shown in said European Publication.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. An elevator comprising:

a pair of elevator guide rails disposed in an elevator hoistway; and an elevator car having a frame supported by ropes from a sheave at the head of the hoistway and a pendulum cab disposed on a platform which is movably suspended on said frame, said frame having a plurality of rail guides disposed thereon and contacting said rails for guiding said elevator within the hoistway;

characterized by the improvement comprising:

a set of electromagnetic actuators for each of said rails, each actuator in each set disposed on an end of said cab near said platform to be in proximity with the corresponding rail so as to exert force between said cab and such rail in response to electric current applied to said actuator.

2. An elevator according to claim 1 including:

a plurality of sensors disposed on an end of said cab near said platform responsive to lateral motion of said cab to provide motion signals indicative thereof; and a control responsive to said sensors for providing current to said actuators to stabilize said cab against motion indicated by said motion signals.

3. An elevator according to claim 1 wherein said rails are tee-shaped and each of said sets include a pair of actuators for providing fore-and-aft forces against the stem of said corresponding rail and an actuator for providing sideways forces to the base of said corresponding rail.

4. An elevator according to claim 1 wherein said guides include actuators, and said car includes a control for providing stabilizing signals to the actuators in said guides.

5. An elevator according to claim 1 wherein said platform is suspended from the top of said frame by rods.

* * * * *